United States Patent [19]

Nakai

[11] Patent Number: 4,508,539

[45] Date of Patent: Apr. 2, 1985

[54] PROCESS FOR IMPROVING LOW QUALITY COAL

[75] Inventor: Masayuki Nakai, Sodegaura, Japan

[73] Assignee: Idemitsu Kosan Company Limited, Tokyo, Japan

[21] Appl. No.: 466,835

[22] Filed: Feb. 16, 1983

[30] Foreign Application Priority Data

Mar. 4, 1982 [JP] Japan ..... 57-32983

[51] Int. Cl.[3] ..... C10L 5/08

[52] U.S. Cl. ..... 44/10 D; 44/1 G; 44/10 L

[58] Field of Search ..... 44/1 G, 10 D, 10 H, 44/10 L

[56] References Cited

U.S. PATENT DOCUMENTS 3,592,617 7/1971 Alpan et al. ..... 44/10 H 3,980,447 9/1976 Franke et al. ..... 44/10 D

FOREIGN PATENT DOCUMENTS 143790 9/1980 Fed. Rep. of Germany ..... 44/10 D

OTHER PUBLICATIONS

Handbook of Briquetting by Franke, vol. I, J. B. Lippincott Co., Philadelphia, 1917, pp. 279, 280.

*Primary Examiner*—Carl F. Dees

*Attorney, Agent, or Firm*—Frishauf, Holtz, Goodman & Woodward

[57] ABSTRACT

A process for improving low quality coal is disclosed, comprising subjecting a crushed low quality coal to a press treatment and a heat treatment. The process of the invention permits the production of improved coal from low quality coal, said improved coal having a high mechanical strength and a high density, and so forth, which realize the ease of handling in storage and transportation without a danger of spontaneous combustion.

15 Claims, No Drawings

PROCESS FOR IMPROVING LOW QUALITY COAL

BACKGROUND OF THE INVENTION

1. Field of the Invention

The present invention relates to a process for improving low quality coal. More particularly, the present invention relates to a process for the production of improved coal from low quality coal, such as brown coal and lignite, which comprises efficiently dehydrating the low quality coal and making it hydrophobic without consuming a large quantity of energy.

2. Description of the Prior Art

In general, low quality coal, such as brown coal, lignite, etc. is not suitable for transportation and handling since, although it has certain properties required for fuel, its water content is high, and it is liable to cause spontaneous combustion when it is dried. Therefore, such low quality coal is used only in and around the areas where it is produced.

A number of methods have been proposed to improve low quality coal by dehydration, including (1) an evaporation process, (2) a mechanical dehydration process, and (3) a nonevaporation type dehydration process. These methods, however, suffer from various disadvantages: for example, the process (1) consumes a large quantity of energy, which is not desirable from an economic viewpoint; the process (2) can remove water only up to about 30%; and the process (3) needs large-sized equipment, which is also not desirable from an economic standpoint.

SUMMARY OF THE INVENTION

The present invention is intended to overcome the above-described problems of the conventional techniques, and the object of the invention is to provide a process for the production of improved coal, i.e., high quality coal, from low quality coal by efficiently dehydrating the low quality coal with simplified equipment and in a simple procedure.

The present invention relates to a process for improving low quality coal which comprises subjecting the low quality coal being crushed to a press treatment and a heat treatment.

DETAILED DESCRIPTION OF THE INVENTION

Any coal which is not suitable as such for transportation and handling because of its high water content can be used as the low quality coal of the invention. There are a number of low quality coals, including brown coal or lignite having a water content of from about 60 to about 70%. A particularly preferred example is brown coal.

In the process of the invention, although the above-described low quality coal can be used as such, it is usually ground (or crushed), because this grinding allows the subsequent press and heat treatments to proceed efficiently. It is not necessary to perform the grinding treatment to such an extent that the low quality coal is ground into a fine powder. In general, it is sufficient to roughly grind the low quality coal to the diameter of about 50 millimeters or less, preferably about 20 millimeters or less by the use of a crusher, etc.

In accordance with the process of the invention, the water contained in low quality coal is removed by subjecting it to a press treatment and a heat treatment.

In a preferred embodiment of the process of the invention, low quality coal which has been crushed is first subjected to the press treatment, and then, in the pressed condition, is subjected to the heat treatment. At the press treatment, a portion of the water contained in low quality coal is squeezed (or extracted) from the low quality coal. This press treatment is usually carried out at ordinary (or ambient) temperature, for example, by the use of apparatus, such as a roll press, a plunger type extruder, etc. The pressure to be applied at the press treatment is not critical, and can be determined appropriately depending on the type of low quality coal, the water content, and so forth. The pressure to be applied is usually from 30 to 200 megapascals (MPa) and preferably from 60 to 100 MPa. When low quality coal is pressed at ordinary temperatures in this manner, fine voids in the low quality coal are compressed, and the water contained in the low quality coal is squeezed therefrom. As a result, the low quality coal is dehydrated to the extent that the water content reaches from about 20 to about 30% by weight. This dehydration by the press treatment produces the advantage that the amount of energy consumed is reduced because it does not need latent heat of vaporization.

Then, the thus-pressed low quality coal is subjected to the heat treatment. Said coal is heated at a temperature of at least 150° C., usually from 150° to 800° C., and preferably from 250° to 500° C. for a period of from 1 to 10 minutes, preferably 1 to 5 minutes, while maintaining said coal in the pressed condition. The pressure under which the low quality coal is pressed during the heat treatment may be the same as that at the above-described press treatment, or may be changed slightly if necessary. This heat treatment under the pressed condition may be performed in the same apparatus as used in the press treatment, or in another apparatus. The press treatment of the coal under the heated condition may be performed in an opened system, or in a container, such as an autoclave.

Upon the application of the heat treatment under the pressed condition, a carboxyl group, a hydroxyl group, and other functional groups contained in the low quality coal are decomposed into carbon dioxide, carbon monoxide, water, etc., which are released from the coal together with the water originally present in the coal. During the heat treatment, tar is formed from the low quality coal, and covers the surface and fine pores of the particles of the low quality coal. The combined action of the covering with tar and the decomposition of hydrophilic functional groups, such as a carboxyl group, and a hydroxyl group, allows the low quality coal to become hydrophobic, and prevents the dehydrated coal from again absorbing moisture. Thus, the low quality coal is converted into improved coal having a reduced water content. Furthermore, since, after the dehydration, the fine pores and compressed and disappear, there is obtained improved coal which is very dense and in a pellet-like form.

The improved coal produced by the process of the invention is sufficiently cooled and, thereafter, taken out as pellets.

As described above, the process of the invention permits the production of pellet-shaped improved coal having a very small water content, a great hydrophobic property, a high density (about 1.2 grams per milliliter (g/ml)), and a high mechanical strength. Thus, the improved coal produced by the process of the invention is of high quality, and furthermore, is of low hygroscopicity, has a high mechanical strength, and is easy for handling, e.g. storage or transportation, since it does not have a nature of producing dust because of its high density and is free from a danger of spontaneous combustion.

Moreover, the process of the invention makes it possible to greatly save the consumption of energy compared with the conventional evaporation method, and therefore, is a very useful method from an industrial viewpoint.

TABLE 1-continued

| | |
|---|---|
| Moisture (% by weight) | 8.9 |
| Ash (% by weight) | [illegible] |
| Volatile Matter (% by weight) | [illegible].6 |
| Fixed Carbon (% by weight) | [illegible].3 |
| Ultimate Analysis (d.a.f.) | |
| Carbon (% by weight) | 4.0 |
| Hydrogen (% by weight) | [illegible].5 |
| Nitrogen (% by weight) | [illegible] |
| Oxygen (% by weight) | 0.3 |
| Sulfur (% by weight) | .2 |
| Calorific Value (d.a.f.) (kcal/kg) | 250 |

TABLE 2

| Run No. | Pressure (MPa) | Temperature (°C.) | Heating Time (min.) | Crushing Strength*1 (MPa) | Water Content*2 (wt. %) | Density (g/cm³) | Dipping Water Content*3 (wt. %) |
|---|---|---|---|---|---|---|---|
| Example 1 | 100 | 155 | 5 | 11 | 14.5 | .8 | [illegible].5 |
| Example 2 | 100 | 155 | 10 | 15 | 14.0 | .7 | [illegible].2 |
| Example 3 | 80 | 250 | 3 | 18 | 10.5 | 21 | [illegible].3 |
| Example 4 | 50 | 250 | 5 | 17 | 10.0 | 20 | [illegible].9 |
| Example 5 | 100 | 250 | 5 | 20 | 11.0 | 22 | [illegible].5 |
| Example 6 | 100 | 350 | 5 | 22 | 12 | 21 | [illegible] |
| Example 7 | 100 | 500 | 3 | 23 | [illegible] | 25 | |
| Example 8 | 100 | 500 | 5 | 22 | [illegible] | 25 | |
| Comparative Example 1 | 200 | 125 | 5 | no pellet formed | 13.0 | – | 17 |
| Comparative Example 2 | 0 | 250 | 5 | no pellet formed | | – | 16 |
| Comparative Example 3 | 0 | 250 | 10 | no pellet formed | | – | [illegible]3 |
| Comparative Example 4 | 200 | 25 | — | [illegible] | 15.0 | 25 | 8.2 |

Note:
*1; Measured according to JIS A 1108.
*2; Equilibrium water content after allowing to stand at room temperature for one week.
*3; Water content after dipping in water for 24 hours.

The present invention is described with reference to the following examples.

EXAMPLES 1 TO 8 AND COMPARATIVE EXAMPLES 1 TO 4

Brown coal mined in Australia, having the properties shown in Table 1 was crushed by the use of a crusher to produce coal particles having a diameter of 20 millimeters or less. Fifteen grams of the thus-produced coal particles were placed in a mold having an inner diameter of 20 millimeters and a length of 70 millimeters, which was then mounted on a pressure molding machine containing a heater. A predetermined amount of pressure was applied onto the mold. At this moment, it was observed that the water was squeezed from the coal, coming out of the mold through a clearance located at a lower portion thereof. While keeping the condition that the pressure was applied onto the mold, the mold was heated at a predetermined temperature for a predetermined time. At this moment, it was also observed that gases and water formed in the mold was scattered from the mold through the clearance. After the heat treatment, the mold was taken out of the pressure molding machine and placed in water. When the mold was sufficiently cooled, pellet-shaped improved coal was taken out of the mold. With the thus-obtained pellet-shaped improved coal, the crushing strength, the equilibrium water content, and the dipping water content were measured, and the results are shown in Table 2.

TABLE 1

| Proximate Analysis (arrival base) | |
|---|---|

What is claimed is:

1. A process for treating coal having a high water content to obtain coal having a lower water content, said process comprising subjecting a coal having a high water content in crushed form to a press treatment at ambient temperature whereby said water-containing coal is pressed without heating and then heating said pressed coal at a temperature of from 250° C. to 500° C. for between 1 and 10 minutes.

2. The process of claim 1, wherein the diameter of the crushed coal is up to 50 millimeters.

3. The process of claim 1, wherein the amount of pressure applied during the press treatment is from 30 to 200 megapascals.

4. The process of claim 1, wherein the low quality coal is selected from the group consisting of brown coal, lignite and a mixture thereof.

5. The process of claim 1, wherein the step of heating is performed for between 1 and 5 minutes.

6. The process of claim 3, wherein the amount of pressure applied during the press treatment is from 60 to 100 megapascals.

7. The process of claim 1, comprising compressing said high water content coal in a pressure molding machine containing a heater and heating said compressed coal by said heater contained in said pressure molding machine.

8. The process of claim 1, wherein the water content of said coal having a lower water content is up to about 30%.

9. The process of claim 2, wherein the diameter of the crushed coal is up to 20 millimeters.

10. A process for treating coal having a high water content selected from the group consisting of brown coal, lignite and a mixture thereof to obtain a coal having a lower water content, said process comprising subjecting a crushed coal having a high water content in crushed form having a diameter of up to 50 millimeters to a press treatment at ambient temperature whereby said water-containing coal is pressed without heating at a pressure of 30 to 200 megapascals and then heating said pressed coal at a temperature of 250° C. to 500° C. for between 1 and 10 minutes.

11. The process of claim 10, wherein the step of heating is performed for between 1 and 5 minutes.

12. The process of claim 10, wherein the amount of pressure applied during the press treatment is from 60 to 100 megapascals.

13. The process of claim 10, comprising compressing said high water content coal in a pressure molding machine containing a heater and heating said compressed coal by said heater contained in said pressure molding machine.

14. The process of claim 10, wherein the water content of sad coal having a lower water content is up to about 30%.

15. The process of claim 10, wherein the diameter of the crushed coal is up to 20 millimeters.

* * * * *